US009209506B2

(12) United States Patent
Kitano et al.

(10) Patent No.: US 9,209,506 B2
(45) Date of Patent: Dec. 8, 2015

(54) RESONANT CIRCUIT HAVING A PLURALITY OF CABLES DISPOSED IN SERIES IN A CIRCULAR MANNER

(75) Inventors: Junichi Kitano, Aichi (JP); Haruo Ikeda, Aichi (JP); Shunsaku Koga, Aichi (JP)

(73) Assignee: Central Japan Railway Company, Aichi (JP)

( * ) Notice: Subject to any disclaimer, the term of this patent is extended or adjusted under 35 U.S.C. 154(b) by 592 days.

(21) Appl. No.: 13/332,709

(22) Filed: Dec. 21, 2011

(65) Prior Publication Data

US 2012/0161906 A1 Jun. 28, 2012

(30) Foreign Application Priority Data

Dec. 28, 2010 (JP) ..... 2010-293400

(51) Int. Cl.
*H01P 7/04* (2006.01)
*H01P 1/205* (2006.01)

(52) U.S. Cl.
CPC ..... *H01P 1/2053* (2013.01)

(58) Field of Classification Search
CPC ..... H01P 1/2053; H01P 7/04; H01P 1/202
USPC ..... 333/222, 223, 243
See application file for complete search history.

(56) References Cited

U.S. PATENT DOCUMENTS 2,115,761 A * 5/1938 Blumlein ..... 343/790
2,231,152 A * 2/1941 Buschbeck ..... 333/26
3,245,009 A * 4/1966 Buschbeck ..... 333/26
4,222,016 A * 9/1980 Stock et al. ..... 333/24 R
4,304,713 A * 12/1981 Perelman ..... 264/45.9
4,552,989 A * 11/1985 Sass ..... 174/103
2004/0118591 A1* 6/2004 Bufanda et al. ..... 174/106 R

FOREIGN PATENT DOCUMENTS

JP S5171944 U 6/1976
JP H11251807 A 9/1999
JP 3303764 7/2002

OTHER PUBLICATIONS

Notice of Reason for Rejection dated Jul. 22, 2014 for corresponding Japanese Patent Application No. 2010-293400 with English translation, 4 pages.

* cited by examiner

*Primary Examiner* — Robert Pascal
*Assistant Examiner* — Kimberly Glenn
(74) *Attorney, Agent, or Firm* — James L. Young; Westman, Champlin & Koehler

(57) ABSTRACT

A resonant circuit includes a plurality of cables, each of which including: an outer conductor made of a conductive material in a cylindrical manner; an inner conductor, made of a conductive material in an elongated manner, and disposed inside of the outer conductor; and an insulator disposed between the outer conductor and the inner conductor. The plurality of cables is disposed in series in a circular manner. The inner conductor, provided in one of adjacently disposed cables among the plurality of cables, is conductively connected to the outer conductor of another of the adjacently disposed cable.

14 Claims, 9 Drawing Sheets

| | INNER CONDUCTOR | OUTER CONDUCTOR |
|---|---|---|
| EXAMPLE 1 | COPPER | ALUMINUM + COPPER |
| EXAMPLE 2 | COPPER | COPPER |
| EXAMPLE 3 | ALUMINUM + COPPER | ALUMINUM + COPPER |
| ⋮ | ⋮ | ⋮ |

FIG.4

RESONANT CIRCUIT HAVING A PLURALITY OF CABLES DISPOSED IN SERIES IN A CIRCULAR MANNER

CROSS-REFERENCE TO RELATED APPLICATION

This application claims the benefit of Japanese Patent Application No. 2010-293400 filed on Dec. 28, 2010 in Japanese Patent Office, the disclosure of which is incorporated herein by reference.

BACKGROUND

The present invention relates to a resonant circuit, particularly, a resonant circuit suitable for large size installation.

A LC resonant circuit, wherein the characteristics of a coil and a condenser are used, is generally known as a resonant circuit. For a LC resonant circuit installed in a large size, a structure shown in FIG. 6 is adopted wherein a circuit 200, disposed in a ring manner so as to work as a coil, includes condensers 210 disposed with predetermined intervals in between (see, for example, Japanese Patent No. 3303764). In FIG. 6, power sources 30, which supply electric power to the LC resonant circuit, are disposed in the circuit 200.

SUMMARY

However, as the publication of the above-described Japanese Patent No. 3303764 discloses, a LC resonant circuit with condensers has been having a problem with providing space for the condensers, because as the size of the resonant circuit becomes larger, more space is needed so as to install more condensers. Moreover, there has been another problem in that, as the number of condensers increases, possibility for failure in the LC resonant circuit, generated due to malfunction of the condensers, becomes high, which lowers the reliability of the circuit.

In a case wherein large capacity is required to condensers, problems can be easily caused during prolonged use of the condensers, such as the capacity being decreased or the condensers getting damaged. In order to maintain the reliability of the conventional LC resonant circuit, regular inspections, for example, have been needed.

In one aspect of the present invention, a resonant circuit, which can be installed in a simple manner and can inhibit the reliability degradation, is preferably provided.

A resonant circuit according to the present invention includes a plurality of cables, each of which including: an outer conductor made of a conductive material in a cylindrical manner; an inner conductor, made of a conductive material in an elongated manner, and disposed inside of the outer conductor; and an insulator disposed between the outer conductor and the inner conductor. The plurality of cables is disposed in series in a circular manner. The inner conductor, provided in one of adjacently disposed cables among the plurality of cables, is conductively connected to the outer conductor of another of the adjacently disposed cables. The plurality of cables, disposed in the circular manner as described above, has inductance L, and the inner conductors, the outer conductors, and the insulators of the plurality of cables have capacitance C. Therefore, a LC resonant circuit is constituted.

That is, since the resonant circuit is constructed by disposing the cables, having both the inductance L and the capacitance C, in the circular manner, space exclusively for disposing the cables is required. Additional space for installing condensers is not necessary, as required in the resonant circuit disclosed in the above-described conventional art document.

Moreover, the capacitance C may be increased by adjusting the thickness of the insulators and the length of the cables. Therefore, as compared to a case wherein condensers, which have large capacity but also have possibility of breakage and reliability concerns, are used, reliability degradation can be easily inhibited in the resonant circuit according to the present invention by using the capacitance of the cables having low possibility of breakage.

Furthermore, connecting portions are preferably provided so as to conductively connect the adjacently disposed cables among the plurality of cables disposed in the circular manner. Still furthermore, a plurality of cables is preferably electrically connected in parallel and disposed between the connecting portions which are adjacently disposed. Consequently, the capacitance in the resonant circuit can be easily increased.

In order to increase the capacitance in the cables having the above-described structure, one of the following ways is generally adopted: either to make the thickness of the insulators thin, or to increase the permittivity of the insulators.

However, there is a limit to increase the capacitance by thinning the thickness of the insulators. This is because the insulators need to have a minimum thickness required so as to provide sufficient pressure resistance to the resonant circuit and the cables. On the other hand, according to the present invention wherein the cables are disposed in parallel, the capacitance can be easily increased while the minimum thickness of the insulators is maintained for the sufficient pressure resistance.

There is also a limit to increase the capacitance by increasing the permittivity of the insulators, because the type of materials that can be used for the insulators is limited. On the other hand, according to the present invention wherein the cables are disposed in parallel, the capacitance can be easily increased without relying upon the material of the insulators.

In the resonant circuit according to the present invention, the plurality of cables is disposed in a circular manner, the inner conductor of one of the adjacently disposed cables among the plurality of cables is conductively connected to the outer conductor of another of the adjacently disposed cables, and the insulator is disposed between the outer conductor and the inner conductor. Therefore, the plurality of cables, disposed in the circular manner, has the inductance L, and the inner conductors, the outer conductors, and the insulators of the plurality of cables have the capacitance C. As a result, the LC resonant circuit can be constructed without additionally providing condensers, and installation of the resonant circuit can be simplified. Moreover, since condensers, having possibility of breakage, are not needed to be used, reliability degradation of the resonant circuit can be inhibited.

BRIEF DESCRIPTION OF THE DRAWINGS

The invention will now be described below, by way of example, with reference to the accompanying drawings, in which:

FIG. 4 is a chart showing examples of compositions of an inner conductor and the outer conductor;

DETAILED DESCRIPTION OF THE PREFERRED EMBODIMENTS

[First Embodiment]

A resonant circuit according to the first embodiment of the present invention will be described below with reference to FIGS. 1A-1D and FIG. 2.

A resonant circuit 1 according to the first embodiment of the present invention is a LC resonant circuit, in which properties of coils and condensers are utilized, and which is installed in a relatively large dimension (the length of the resonant circuit can be, for example, tens to hundreds of meters).

Figure 1A:
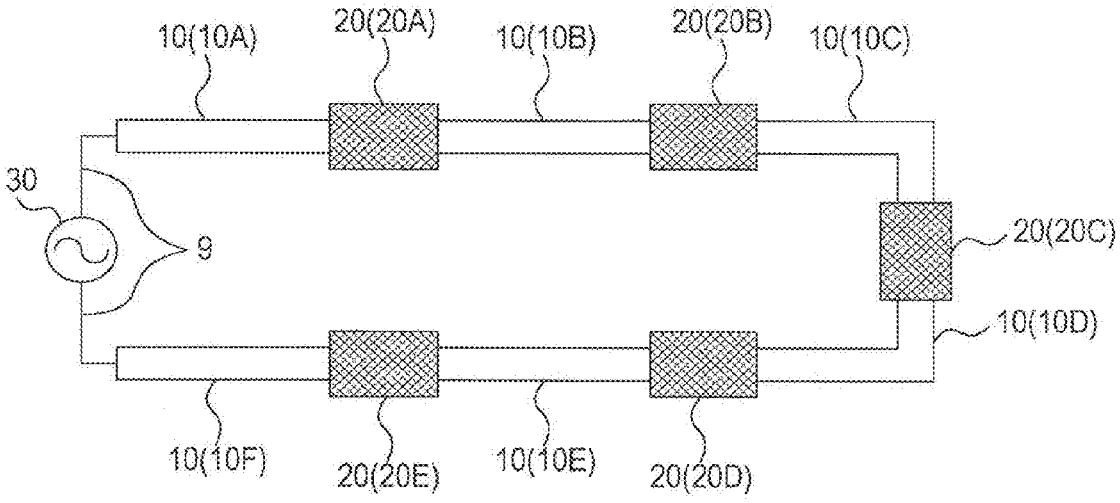
FIG. 1A is an explanatory view showing a structure of a resonant circuit according to a first embodiment of the present invention.
Figure 1B:
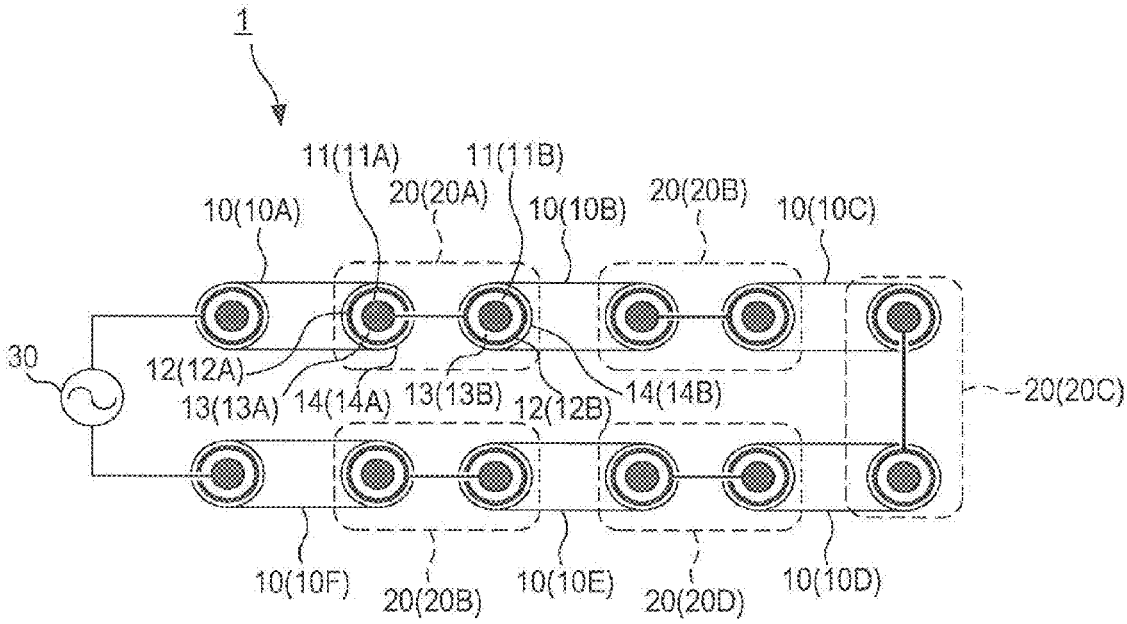
FIG. 1B is a schematic view illustrating the structure of the resonant circuit according to the first embodiment of the present invention.
Figure 1C:
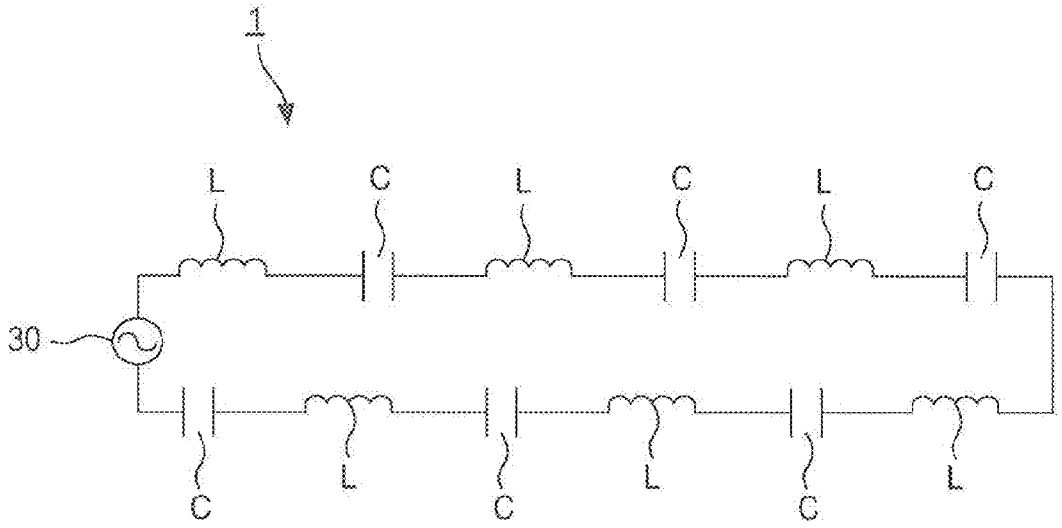
FIG. 1C is an equivalent circuit diagram of the resonant circuit according to the first embodiment of the present invention.
Figure 1D:
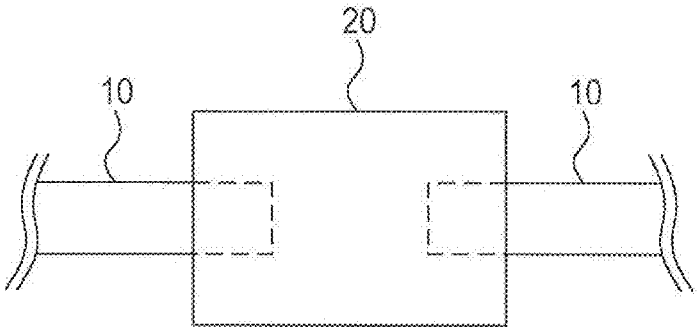
FIG. 1D is an explanatory view showing one example of a structure of a connecting portion of the resonant circuit according to the first embodiment of the present invention.
Figure 2:
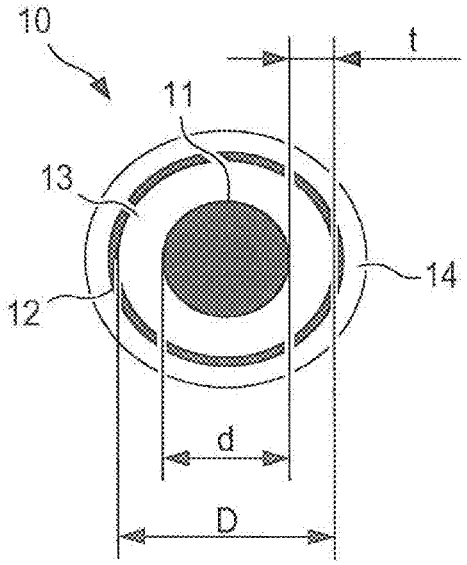
FIG. 2 is a schematic view showing a structure of coaxial cables shown in FIGS. 1A and 1B.

As shown in FIGS. 1A, 1B and 2, the resonant circuit 1 includes a plurality of coaxial cables 10, a plurality of connecting portions 20, and a power source 30. In the embodiment shown in FIGS. 1A, 1B and 2, the resonant circuit 1 is provided with six coaxial cables 10. In order to connect the six coaxial cables 10, the resonant circuit 1 is provided with five connecting portions 20. It is to be noted that the number of the coaxial cables 10 can be any plural number, and that the number of the connecting portions 20 is one piece less than the number of the coaxial cables 10.

In the following, when each of the plurality of coaxial cables 10 needs to be distinguishably explained, the plurality (six) of coaxial cables 10 will be referred to as coaxial cables 10A-10F. Similarly, the plurality (five) of connecting portions 20 will be referred to as connecting portions 20A-20E.

As shown in FIGS. 1A and 1B, the coaxial cables 10 are connected in series. In the resonant circuit 1 according to the present embodiment, one end of the coaxial cable 10A is connected to one end of the coaxial cable 10B via the connecting portion 20A. The other end of the coaxial cable 10B is connected to one end of the coaxial cable 10C via the connecting portion 20B. The rest of the coaxial cables 10D-10F are similarly connected, so that the coaxial cables 10A-10F are connected via the connecting portions 20A-20E in a circular manner (in other words, a coil manner).

The other end of the coaxial cable 10A (that is not connected to the connecting portion 20A) is connected to the power source 30. Moreover, one end of the coaxial cable 10F (that is not connected to the connecting portion 20E) is also connected to the power source 30. The power source 30 supplies alternating current. In the embodiment shown in FIGS. 1A and 1B, the coaxial cables 10A, 10F, and the power source 30 are connected via conductors 9. It is to be noted that the conductors 9 may be formed as one portion of connectors. That is, the coaxial cables 10A, 10F and the power source 30 may be connected by the connectors including the conductors 9.

The coaxial cables 10 work as coils and condensers of the resonant circuit 1. Specifically, the coaxial cables 10 provide inductance L and capacitance C in the equivalent circuit diagram shown in FIG. 1C. By disposing the plurality of coaxial cables 10 in the circular manner, the coaxial cables 10 is constructed in a manner, similar to a single-turn coil, so as to have the inductance L.

As shown in FIG. 2, each of the coaxial cables 10 includes an inner conductor 11, an outer conductor 12, an insulator 13, and a protection covering 14.

The inner conductor 11 is made of an elongate conductor. In the present embodiment, the inner conductor 11 is formed in a columnar manner. However, it is to be noted that the shape of the inner conductor 11 is not limited to the columnar manner.

Figure 3:
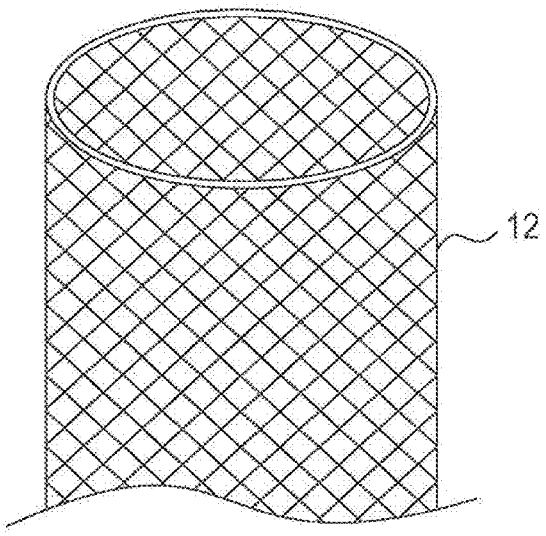
FIG. 3 is an explanatory view showing one example of an outer conductor according to the first embodiment.

The outer conductor 12 is made of a cylindrical conductive material. Inside of the cylindrical shape (that is, inside of the outer conductor 12), the inner conductor 11 and the insulator 13 are disposed. The outer conductor 12 may be constituted with a conductive material formed in a single-piece cylinder manner, or with conductive thin wires woven in a cylindrical manner (see FIG. 3 for the latter example). The structure of the outer conductor 12 is not specifically limited.

For the conductive material, metallic materials having high conductivities (such as copper or aluminum) and alloy materials made of these metallic materials may be used. Moreover, the conductive material constituting the inner conductor 11 and the conductive material constituting the outer conductor 12 may have an identical composition, or alternatively have unidentical compositions. The compositions of the conductive materials are not specifically limited (see FIG. 4).

The insulator 13 is disposed in a cylindrical area between the inner conductor 11 and the outer conductor 12, and keeps electrical insulation between the inner conductor 11 and the outer conductor 12. The thickness t of the insulator 13 is required to be equal to or larger than thickness tv, with which the insulation is not destroyed by the voltage applied to the resonant circuit 1 (i.e., the pressure resistance can be maintained). The thickness t of the insulator 13 can be determined by $t=(D-d)/2$, wherein "D" is the internal diameter (the diameter of the inner circumference) of the outer conductor 12, and "d" is the external diameter (the diameter) of the inner conductor 11.

On the other hand, the thickness t of the insulator 13 is required to be smaller than thickness tc, in order to maintain the capacitance C, that is the capacitance the resonant circuit 1 is required to have. If the thickness t is equal to or larger than the thickness tc, the capacitance C cannot be maintained. A specific value for the thickness tc can be variable depending on the characteristics of the materials constituting the insulator 13, and on other factors.

For the material constituting the insulator 13, materials having insulation property and also large permittivity, such as cross-linked polyethylene and other resin materials, may be used. Particularly, from the aspect of increasing the capacitance C, materials having a large permittivity are preferably used. If the permittivity of the materials forming the insulator 13 is large, a larger value can be set for the aforementioned thickness tc, which is necessary in order to maintain the capacitance C. Consequently, the thickness t of the insulator 13 can have a larger value. In this case, both the pressure resistance and the capacitance C can be easily maintained.

The protection covering 14 is provided so as to protect the outer conductor 12, and covers the outermost circumference of the coaxial cable 10. Moreover, the protection covering 14 is provided so as also to insulate the outer conductor 12 from the exterior. For the material constituting the protection covering 14, materials having at least insulation property, for example, resin such as vinyl resin, may be used. It is to be noted that the protection covering 14 may be formed by using the same material constituting the insulator 13, and that the material for the protection cover 14 is not particularly limited.

As shown in FIGS. 1A and 1B, each of the connecting portions 20 connects two coaxial cables 10. The connecting portions 20 may be made as connectors that hold the coaxial cables 10 in an attachable/detachable manner (see FIG. 1D).

Each of the connecting portions 20 conductively connects the inner conductor 11 of one coaxial cable 10 and the outer conductor 12 of another coaxial cable 10. This connection manner is more specifically explained below with reference to FIG. 1B. The coaxial cable 10A and the coaxial cable 10B are connected by the connecting portion 20A. The connecting portion 20A conductively connects the inner conductor 11A of the coaxial cable 10A and the outer conductor 12B of the coaxial cable 10B.

As shown in FIGS. 1A and 1B, out of the connecting portions 20A and 20B which are connected to the coaxial cable 10B, the connecting portion 20A is conductive to the outer conductor 12B of the coaxial cable 10B, whereas not conductive to the inner conductor 11B of the coaxial cable 10B. The connecting portion 20B is conductive to the inner conductor 11B of the coaxial cable 10B, whereas not conductive to the outer conductor 12B of the coaxial cable 10B.

That is, in one end portion of the coaxial cable 10B (disposed in the connecting portion 20A side), the outer conductor 12B becomes conductive via the connecting portion 20A, while the inner conductor 11B is kept nonconductive (insulated state). In the other end portion of the coaxial cable 10B (disposed in the connection portion 20B side), the inner conductor 11B becomes conductive via the connecting portion 20B, while the outer conductor 12B is kept nonconductive (insulated state).

Due to the structure described above, each of the coaxial cables 10 is constituted, similarly to a condenser, so as to have the capacitance C and, therefore, to be able to temporarily store electric charge.

The power source 30 is connected to the outer conductor 12A of the coaxial cable 10A and the inner conductor 11F of the coaxial cable 10F so as to supply alternating current to the resonant circuit 1. The frequency of the alternating current supplied to the resonant circuit 1 may be, for example, a frequency in which resonance is generated in the resonant circuit 1 (resonant frequency), and which can be obtained by $\omega=1/\sqrt{(LC)}$. It is to be noted that the power source 30 and the coaxial cables 10 (10A and 10F) may be conductively connected in a direct manner, or may be conductively connected via other cables and the like, and that the connection manner is not limited to a specific way.

The following describes the operation in the resonant circuit 1 constructed as above.

When alternating current is supplied from the power source 30 to the resonant circuit 1, electric charge is temporarily stored between the inner conductor 11 and outer conductor 12 of each of the coaxial cables 10 (the portion constituting the capacitance C), corresponding to fluctuation in the alternating current. The electric charge stored in one coaxial cable 10 moves toward another coaxial cable 10 adjacently disposed (moving direction). Consequently, electric current starts flowing between adjacent coaxial cables 10. The current flowing in the coaxial cable 10 generates a concentric magnetic field around the coaxial cable 10. At this time, the electric charge stored between the inner conductor 11 and the outer conductor 12 continues to decrease.

When the electric charge stored between the inner conductor 11 and the outer conductor 12 is completely discharged, the electric current, flowing in the coaxial cable 10, is maintained due to the magnetic field formed around the coaxial cable 10. Moreover, electric charge starts being stored between the inner conductor 11 and the outer conductor 12 of the coaxial cable 10 adjacently disposed to the coaxial cable 10 in which electric charge is initially stored. At this time, since the current, flowing in the coaxial cable 10, is maintained, the strength of the magnetic field formed around the coaxial cable 10 becomes small. When the strength of the magnetic field becomes small, the current value of the current flowing in the coaxial cable 10 consequently becomes small.

By the time when the magnetic field around the coaxial cable 10 disappears, electric charge is stored between the inner conductor 11 and the outer conductor 12 of the adjacently disposed coaxial cable 10. Subsequently, the stored electric charge starts moving toward the coaxial cable 10 wherein electric charge is initially stored (in the direction opposite to the moving direction mentioned earlier), and the above-described cycle is repeated. Moreover, since alternating current, having resonant frequency $\omega$, which corresponds to the periodic length of the above-described cycle, is supplied from the power source 30, a resonant state is kept in the resonant circuit 1.

According to the above-described structure, the resonant circuit 1 is constituted by disposing the coaxial cables 10, which work not only as coils but also condensers, in a circular manner, and space exclusively for disposing the coils is required. Therefore, additional space for disposing condensers is not needed, unlike in the resonant circuit disclosed in the above-mentioned prior art document.

Moreover, by adjusting the thickness of the insulators 13 and the length of the coaxial cables 10, the capacitance in the coaxial cables 10 can be adjusted and increased. Therefore, as compared to a case wherein condensers, which have large capacity but also have possibility of breakage and reliability concerns, are used, reliability degradation in the resonant circuit 1 can be easily inhibited by using the capacitance of the coaxial cables 10, which have low possibility for breakage.

[Second Embodiment]

Figure 5:
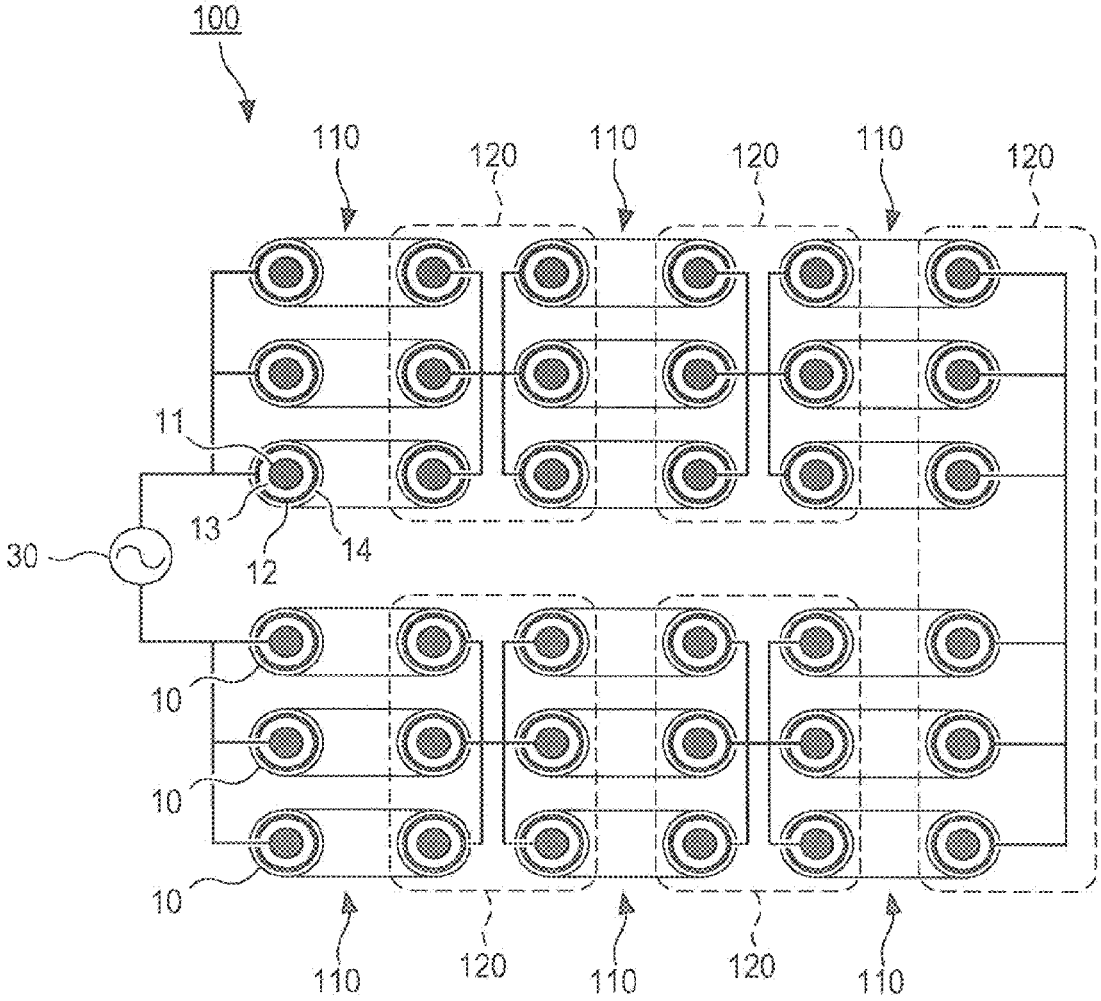
FIG. 5 is a schematic view illustrating a structure of a resonant circuit according to a second embodiment of the present invention.
Figure 6:
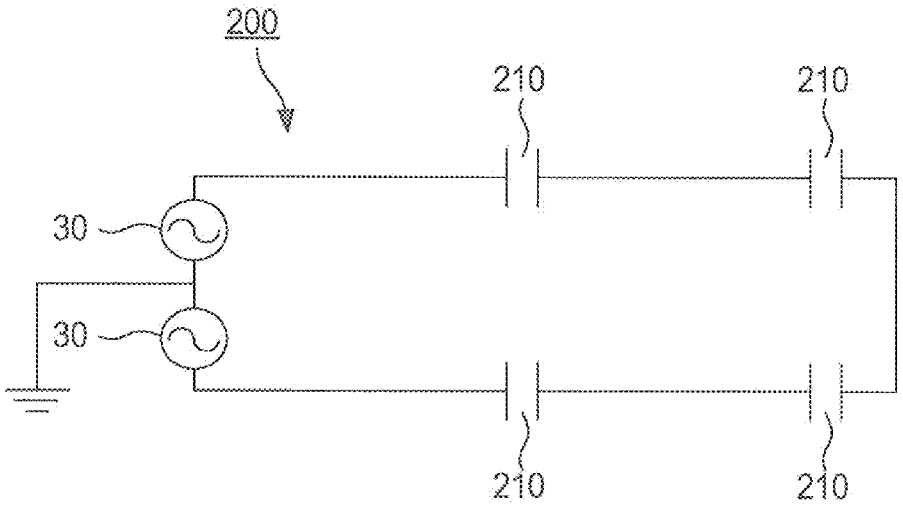
FIG. 6 is a circuit diagram illustrating a structure of a conventional resonant circuit.

Referring now to FIG. 5, a second embodiment according to the present invention will be described.

The basic structure of the resonant circuit according to the second embodiment is basically the same as the structure according to the first embodiment. However, disposition of the coaxial cables 10 is different from the first embodiment. In the second embodiment, the disposition of the coaxial cables 10 will be explained with reference to FIG. 5, but the description of other constituents will be omitted.

As shown in FIG. 5, a resonant circuit 100 according to the second embodiment has a structure, wherein a plurality of coaxial cables 10 are electrically connecting in parallel so as to make bundles 110 of the coaxial cables 10, and the bundles 110 of the coaxial cables 10 are disposed in a circular manner so as to be electrically connected in series. This structure is different from the first embodiment.

The resonant circuit 100 is provided with the bundles 110 of a plurality of coaxial cables 10, connecting portions 120, and the power source 30.

In the second embodiment, one example will be explained, wherein each of the bundles 110 is formed by combining three coaxial cables 10. Three coaxial cables 10 constituting one bundle 110 are preferably disposed, for example, on a plane surface created by the circular structure of the resonant circuit 100 (the surface of the paper of FIG. 5).

In the same manner as the connecting portions 20 according to the first embodiment, each of the connecting portions 120 is disposed between the bundles 110 of the coaxial cables 10 and connects adjacent bundles 110 of the coaxial cables 10. Each of the connecting portions 120 conductively connects the inner conductors 11 of the coaxial cables 10 in one bundle 110 and the outer conductors 12 of the coaxial cables 10 in another bundle 110 adjacently disposed.

To one end of one of the bundles 110 of the coaxial cables 10, one connecting portion 120 is attached so as to be conductive to the outer conductors 12 of the coaxial cables 10 in the bundle 110, and to keep the inner conductors 11 insulated. To the other end of the bundle 110, another connecting portion 120 is attached so as to be conductive to the inner conductors 11 of the coaxial cables 10 in the bundle 110, and to keep the outer conductors 12 insulated.

The power source 30 is conductively connected to the outer conductors 12 in one end of the serially connected bundles 110 of the coaxial cables 10, and to the inner conductors 11 in the other end, so as to supply alternating current to the resonant circuit 100.

As described above, by disposing the coaxial cables 10, electrically connected in parallel, between adjacently disposed connecting portions 120 so as to increase the number of the coaxial cables 10, the capacitance C in the resonant circuit 100 can be easily increased. Therefore, using the resonant circuit 100 can provide both large capacitance C and high pressure resistance that the coaxial cables 10 are required to have.

In order to increase the capacitance C in the coaxial cables 10, one of the following ways is generally adopted: either to make the thickness of the insulators 13 thin, or to increase the permittivity of the insulators 13.

However, there is a limit to increase the capacitance C by thinning the thickness of the insulators 13. This is because the insulators 13 need to have a minimum thickness required so as to provide sufficient pressure resistance to the resonant circuit 100 and the coaxial cables 10. According to the present embodiment wherein the coaxial cables 10 are disposed in parallel, the capacitance C can be easily increased while the minimum thickness of the insulators 13 is maintained for sufficient pressure resistance.

There is also a limit to increase the capacitance C by increasing the permittivity of the insulators 13, because the type of materials that can be used for the insulators 13 is limited. According to the present embodiment wherein the coaxial cables 10 are disposed in parallel, the capacitance C can be easily increased without relying upon the material of the insulators 13.

Although specific embodiments have been illustrated and described herein, it is to be understood that the above description is intended to be illustrative, and not restrictive. Combinations of the above embodiments and other embodiments will be apparent to those of skill in the art upon reviewing the above description. The scope of the invention includes any other applications in which the above structures are used. Accordingly, the scope of the invention should only be determined with reference to the appended claims, along with the full scope of equivalents to which such claims are entitled.

What is claimed is:

1. A resonant circuit comprising a plurality of cables, each of which including:

an outer conductor made of a conductive material in a cylindrical manner;

an inner conductor, made of a conductive material in an elongated manner, and disposed inside of the outer conductor; and an insulator disposed between the outer conductor and the inner conductor, wherein the plurality of cables is disposed in series in a circular manner, wherein the inner conductor, provided in one of adjacently disposed cables among the plurality of cables, is conductively connected to the outer conductor of another of the adjacently disposed cables, and wherein the outer conductor provided in the one of the adjacently disposed cables and the inner conductor of the another of the adjacently disposed cables are insulated from each other.

2. The resonant circuit according to claim 1, further comprising connecting portions, each of which connects the inner conductor of one of the adjacently disposed cables and the outer conductor of another of the adjacently disposed cables, wherein the plurality of cables, electrically connected in parallel, is disposed between the connecting portions that are adjacently disposed.

3. The resonant circuit according to claim 2, wherein the connecting portions are made as connectors that hold the plurality of cables in an attachable/detachable manner.

4. The resonant circuit according to claim 2, wherein the plurality of cables, electrically connected in parallel and disposed between the connecting portions that are adjacently disposed, are three cables.

5. The resonant circuit according to claim 1, wherein the outer conductors are made of conductive thin wires woven in a cylindrical manner.

6. The resonant circuit according to claim 1, wherein a composition of the outer conductors and a composition of the inner conductors are unidentical.

7. The resonant circuit according to claim 1, wherein a composition of the outer conductors and a composition of the inner conductors are identical.

8. The resonant circuit according to claim 1, wherein the inner conductor provided in the one of adjacently disposed cables is conductively connected to the outer conductor of the another of the adjacently disposed cables such that the adjacently disposed cables provide inductance and capacitance.

9. The resonant circuit according to claim 1, wherein each of the inner conductor and the outer conductor comprises an open end to which nothing is to be connected.

10. The resonant circuit according to claim 1, wherein the inner conductor of the one of the adjacently disposed cables is conductively connected to the outer conductor of the another of the adjacently disposed cables such that a current flowing in the one of the adjacently disposed cables generates a concentric magnetic field around the one of the adjacently disposed cables while electric charge is temporarily stored between the inner conductor and the outer conductor of the another of the adjacently disposed cables.

11. The resonant circuit according to claim 1, wherein the plurality of cables forms a plurality of bundles of cables, each of the plurality of bundles of cables comprising cables electrically connected in parallel each other, and wherein the plurality of bundles of cables is disposed in series in a circular manner.

12. The resonant circuit according to claim 11, wherein each of the plurality of bundles of cables comprises a same number of cables.

13. The resonant circuit according to claim 11, wherein the outer conductor in each cable in each of the plurality of bundles of cables is electrically connected at one end thereof to one end of each of outer conductors in remaining cables in the each of the plurality of bundles of cables, and wherein the inner conductor in each cable in each of the plurality of bundles of cables is electrically connected at one end thereof to one end of each of inner conductors in the remaining cables in each of the plurality of bundles of cables.

14. A method for forming a resonant circuit comprising:

disposing a plurality of cables in series in a circular manner, each of the plurality of cables including:

an outer conductor made of a conductive material in a cylindrical manner;

an inner conductor, made of a conductive material in an elongated manner, and disposed inside of the outer conductor; and an insulator disposed between the outer conductor and the inner conductor;

conductively connecting the inner conductor, provided in one of adjacently disposed cables among the plurality of cables, to the outer conductor of another of the adjacently disposed cables; and insulating the outer conductor provided in the one of the adjacently disposed cables and the inner conductor of the another of the adjacently disposed cables from each other.

* * * * *